US007824194B2

(12) United States Patent
Suzuki et al.

(10) Patent No.: US 7,824,194 B2
(45) Date of Patent: Nov. 2, 2010

(54) CASE WITH CONNECTOR AND MANUFACTURING METHOD THEREOF

(75) Inventors: Yoshikazu Suzuki, Toyota (JP); Akira Ishimaru, Toyota (JP); Tomokiyo Suzuki, Toyota (JP); Hironao Hayashi, Toyota (JP); Shigeru Hayashida, Toyota (JP); Osamu Kuriyagawa, Toyota (JP); Iori Kobayashi, Toyota (JP); Kensuke Nakanishi, Toyota (JP); Toru Takahashi, Obu (JP); Yuki Yamakawa, Nishikamo-gun (JP); Masanori Sumida, Nagoya (JP)

(73) Assignees: Toyota Jidosha Kabushiki Kaisha, Toyota (JP); Matsuo Industries, Inc., Obu (JP)

( * ) Notice: Subject to any disclaimer, the term of this patent is extended or adjusted under 35 U.S.C. 154(b) by 75 days.

(21) Appl. No.: 12/087,544

(22) PCT Filed: Mar. 1, 2007

(86) PCT No.: PCT/JP2007/053944

§ 371 (c)(1),
(2), (4) Date: Jul. 9, 2008

(87) PCT Pub. No.: WO2007/100056

PCT Pub. Date: Sep. 7, 2007

(65) Prior Publication Data

US 2009/0068865 A1 Mar. 12, 2009

(30) Foreign Application Priority Data

Mar. 2, 2006 (JP) ..... 2006-056292

(51) Int. Cl.
*H01R 4/66* (2006.01)

(52) U.S. Cl. ..... 439/92; 439/95; 439/607.27

(58) Field of Classification Search ..... 439/92, 439/607.27, 95, 607.28, 98
See application file for complete search history.

(56) References Cited

U.S. PATENT DOCUMENTS 5,718,605 A * 2/1998 Morikawa et al. ..... 439/607.27

(Continued)

FOREIGN PATENT DOCUMENTS

| | | |
|---|---|---|
| JP | A-2000-317980 | 11/2000 |
| JP | A-2000-357563 | 12/2000 |
| JP | A-2002-025718 | 1/2002 |
| JP | A-2002-373737 | 12/2002 |
| JP | A-2003-272779 | 9/2003 |

OTHER PUBLICATIONS

Chinese Office Action issued in Chinese Patent Application No. 200780007106.2 (with translation).

*Primary Examiner*—Hien Vu
(74) *Attorney, Agent, or Firm*—Oliff & Berridge, PLC

(57) ABSTRACT

A case with a connector integrally formed with a resin connector, and can be manufactured with a small number of processes is provided. The connector case includes a housing, a resin connector, and a ground terminal extending along an outer periphery of the connector. A terminal-side fixing portion extending backward from the ground terminal is crimped to or pressed over a housing-side fixing portion. When molds are closed after the housing and the ground terminal are placed in the molds for injection molding of the resin connector, a pressing portion formed on the mold presses the terminal-side fixing portion against the housing-side fixing portion to crimp or press the terminal-side fixing portion to or over the housing-side fixing portion. As a result, in the process for the injection molding of the connector, the ground terminal is fixed to the housing at the same time. The connector case with the ground terminal fixed to the housing can be manufactured in a small number of processes.

2 Claims, 11 Drawing Sheets

U.S. PATENT DOCUMENTS 5,980,320 A * 11/1999 Slack et al. ..... 439/607.27
6,287,147 B1 * 9/2001 Lin ..... 439/607.27
6,343,941 B1 * 2/2002 Kan ..... 439/95
6,716,071 B2 4/2004 Miyazaki
2005/0042923 A1 * 2/2005 Zhu et al. ..... 439/607
2007/0082518 A1 * 4/2007 McDowell et al. ..... 439/92

* cited by examiner

CASE WITH CONNECTOR AND MANUFACTURING METHOD THEREOF

CROSS-REFERENCE TO RELATED APPLICATION

This present application claims a priority based on Japanese Patent Application No. 2006-056292 filed on Mar. 2, 2006, the entire contents of which are hereby incorporated by reference into the present application.

BACKGROUND OF THE INVENTION

1. Field of the Invention

The present invention relates to a case with a connector. More particularly, the present invention relates to a case with a connector where the connector is fixed to a housing, and a ground terminal and a connection terminal are fixed by the connector. The ground terminal herein implies a ground terminal which is connected to the housing, and is thus maintained to an electric potential equal to that of the housing. The connection terminal herein implies a terminal that extends across the inside and the outside of the housing without being in contact with the housing, thereby transmitting an electric signal or an electric power across the inside and the outside of the housing.

2. Description of the Related Art

A case with a connector is configured such that the connector is fixed to a housing, the connector fixes a connection terminal which extends across the inside and the outside of the housing without contact with the housing, and the connection terminal transmits an electric signal or an electric power across the inside and the outside of the housing. Among cases with a connector of this type, there is a case with a connector where one of the terminals does not enter the housing, and is electrically connected to the housing. In this case, the housing is often made of a conductive material, and the case is often used while the housing is at the ground electrical potential. Whether the housing is set to the ground electrical potential or not, if a terminal connected to the housing is provided, it is possible to maintain the electrical potential of a specific portion of an object connected to the electrical appliance equal to the electric potential of the housing by connecting the specific portion to the terminal. This type of terminal is herein referred to as ground terminal. On the other hand, the terminal which extends across the inside and outside of the housing without contact with the housing is referred to as connection terminal.

Japanese Patent Publication No. 2002-373737 (patent publication 1) discloses a technology which engages a ground shell on an outer periphery of a resin connector and fastens the ground shell to a housing with a bolt, thereby fixing the resin connector to the housing.

BRIEF SUMMARY OF THE INVENTION

The technology disclosed in the patent publication 1 includes a step of forming the connector by injection molding, a step of fixing the connector to the ground shell, and a step of fastening the ground shell to the housing with the bolt. The technology disclosed in the patent publication 1 requires a large number of processes for manufacturing the case with a connector.

There is a need for a case with a connector which can be manufactured with a smaller number of processes, and a manufacturing method thereof.

The inventors have created a case with a connector which can be manufactured with a small number of processes. This case for an electric appliance includes a conductive housing, a conductive ground terminal which is electrically in contact with the housing, and a conductive connection terminal which is not electrically in contact with the housing. This case for an electric appliance has a resin connector which insulates between the connection terminal and the housing and between the connection terminal and the ground terminal. This case with a connector can be manufactured by forming the resin connector by injection molding while the housing, the ground terminal, and the connection terminal are arranged in molds for the injection molding. According to the present invention, it is possible to efficiently manufacture a case with a connector excellent in quality. Moreover, by securely connecting the housing and the ground terminal with each other by a force caused while closing the molds for the injection molding, it is possible to maintain a stable electrical connection between the housing and the ground terminal for a long period, thereby successfully manufacturing the case with a connector with a smaller number of processes and high reliability.

A case with a connector devised according to the present invention includes a conductive housing, a conductive ground terminal that is electrically in contact with the housing, a conductive connection terminal that is not electrically in contact with the housing, and a resin connector. The resin connector is formed integrally with the housing, the ground terminal, and the connection terminal, and insulates between the connection terminal and the housing, and between the connection terminal and the ground terminal. The housing has a housing-side fixing portion that fixes the ground terminal. The ground terminal has a terminal-side fixing portion that is fixed to the housing-side fixing portion. In the case with a connector devised according to the present invention, the terminal-side fixing portion is crimped to or pressed over the housing-side fixing portion so as to secure an electrical contact. A space formed between the housing, the connection terminal, and the ground terminal is filled with the resin connector. Relative positional relationships between the connection terminal and the housing, and between the connection terminal and the ground terminal are fixed by a connector. In the case with a connector devised according to the present invention, at least a part of the ground terminal is covered with the connector.

In the above case with a connector, the space formed between the housing, the connection terminal, and the ground terminal is filled with the connector, and the connecter surely separates the inside and the outside of the housing. The connector surely separates the space inside the housing from the outside. Moreover, it is not necessary to form the connector in advance, and then to fix the ground terminal to the housing. The ground terminal is fixed to the housing by forming the resin connector. The above case with a connector does not require an independent step of crimping or pressing the ground terminal to or over the housing. In order to crimp or press the terminal-side fixing portion to or over the housing-side fixing portion, it is only necessary to apply a pressing force either to the housing-side fixing portion or the terminal-side fixing portion. The ground terminal can be fixed to the housing in the step of closing the molds for the injection molding. According to the present invention, at least a part of the ground terminal is covered with the connector, and the connector itself contributes to fixing the ground terminal. The ground terminal is fixed to at least the housing-side fixing portion by the connector, and it is possible to stably secure the state where the housing and the ground terminal are electrically properly in contact with each other for a long period. The above case with a connector is reliable, and can be manufactured with a small number of processes at a low cost.

It may be preferable that at least a part of the contact portion between the housing-side fixing portion and the terminal-side fixing portion is not covered with the connector. If at least a part of the contact portion is not covered with the connector, it is possible to externally observe the contact portions therebetween. Conversely, the contact portion may be preferably covered with the connector. If the contact portion is covered with the connector, it is possible to protect the contact portion from the external environment.

The ground terminal preferably has a shield portion that extends as a tube along a periphery of (an outer or inner periphery of) the connector. Especially, the ground terminal preferably has the shield portion on the outer periphery of the connector. If the ground terminal includes the shield portion, it is possible to electrically shield between the inside and the outside of the connector, thereby preventing external noises from influencing an electrical signal passing the connection terminal, and conversely preventing the electrical signal or an electric power passing the connection terminal from emitting noises to the outside.

A manufacturing method devised according to the present invention includes the following steps. A first step arranges a housing, a ground terminal, and a connection terminal in open molds. A housing-side fixing portion for fixing the ground terminal is provided on the housing. A terminal-side fixing portion for being fixed to the housing is provided on the ground terminal. In the first step, the terminal-side fixing portion is aligned to the housing-side fixing portion, and the connection terminal is aligned to a through hole on the housing so as to pass the through hole without contact therebetween in the mold. There is then carried out a second step of, upon closing the molds, causing a mold-side pressing portion formed at a position corresponding to at least either one of the housing-side fixing portion and the terminal-side fixing portion to press the housing-side fixing portion and the terminal-side fixing portion to each other to bring the housing-side fixing portion and the terminal-side fixing portion in electrical contact with each other, and closing the molds so as to form a cavity which isolates a space formed between the connection terminal, the housing and the connection terminal from the outside. There is then carried out a third step of injecting molten resin into the cavity formed in the molds so as to form a connector.

According to the above manufacturing method, it is possible to apply the pressing force either to the housing or the ground terminal in the step of closing the mold for injection molding, thereby bringing the condition where both of them are electrically in contact with each other properly for a long period. A reliable case with a connector can be manufactured with a small number of steps at a low cost.

Contact portions between the housing-side fixing portion and the terminal-side fixing portion can be exposed inside the cavity when the molds are closed in the second step. It is thus possible to manufacture a case with a connector including the contact portions covered with the connector. In this case, the injected molten resin flows in a periphery of the contact portions. A pressure of the molten resin presses the ground terminal against the housing in the periphery of the contact portions. It is thus possible to more surely fix the housing and the ground terminal to each other. It is therefore possible to more surely secure the electrical contact between the housing and the ground terminal.

When the molds are closed in the second step, at least a part of a contact portion between the housing-side fixing portion and the terminal-side fixing portion is separated from the cavity. It is thus possible to manufacture a case with a connector including at least a part of the contact portion covered with the connector. It is therefore possible to externally inspect the contact condition between the housing and the ground terminal after the case with a connector is completed.

It is preferable that the housing-side fixing portion is formed into a protruded shape, the terminal-side fixing portion includes a hole through which the protruded housing-side fixing portion passes, and the mold presses either one of the housing-side fixing portion and the terminal-side fixing portion so that the terminal-side fixing portion is crimped to or pressed over the housing-side fixing portion. In this case, the housing-side fixing portion and the terminal-side fixing portion are rubbed strongly against each other. Even if non-conductive layers such as oxide layers are formed on the contact portions before the fixing, the non-conductive layers are removed by the crimping or press-in. It is thus possible to surely secure the electrical contact condition between the housing and the ground terminal.

The housing-side fixing portion may be formed into a grooved shape, the terminal-side fixing portion may be formed into a protruded shape, and the mold may press either one of the housing-side fixing portion and the terminal-side fixing portion so that the terminal-side fixing portion in the protruded shape is pressed into the housing-side fixing portion in the grooved shape. Also in this case, even if non-conductive layers such as oxide layers are formed on the contact portions before the fixing, the non-conductive layers are removed by the crimping or press-in. It is thus possible to surely secure the electrical contact state between the housing and the ground terminal.

The ground terminal preferably has a shield portion that extends as a tube along a periphery (an outer or inner periphery) of the connector. If the ground terminal has the shield portion, it is possible to electrically shield between the inside and the outside of the connector, thereby preventing external noises from influencing the electrical signal passing the connection terminal, and conversely preventing the electrical signal or the electric power passing the connection terminal from emitting noises to the outside.

According to the present invention, a case with a connector, in which the resin connector is formed integrally with the conductive housing, can be realized with high reliability. The case with connector devised from the present invention can maintain the electric potential of an external device equal to the electric potential of the housing upon connecting the external device to the ground terminal. Moreover, it is possible to manufacture a reliable case with a connector efficiently with a small number of steps at a low cost.

BRIEF DESCRIPTION OF THE DRAWINGS

FIGS. 10 show a variation in the shape of a terminal-side fixing portion of a ground terminal, in which:

Figure 4:
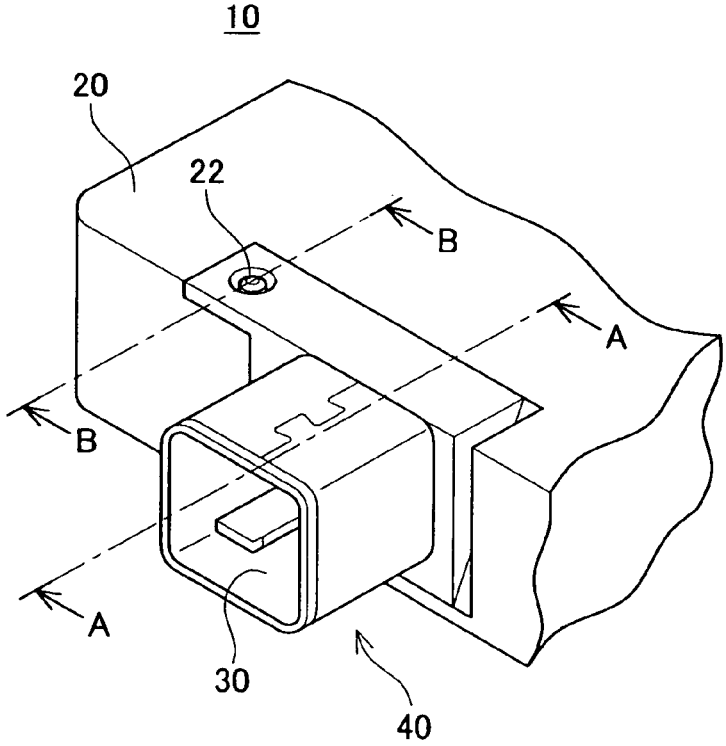
FIG. 4 is an enlarged view of a periphery of the connector shown in FIG. 1.
Figure 8A:
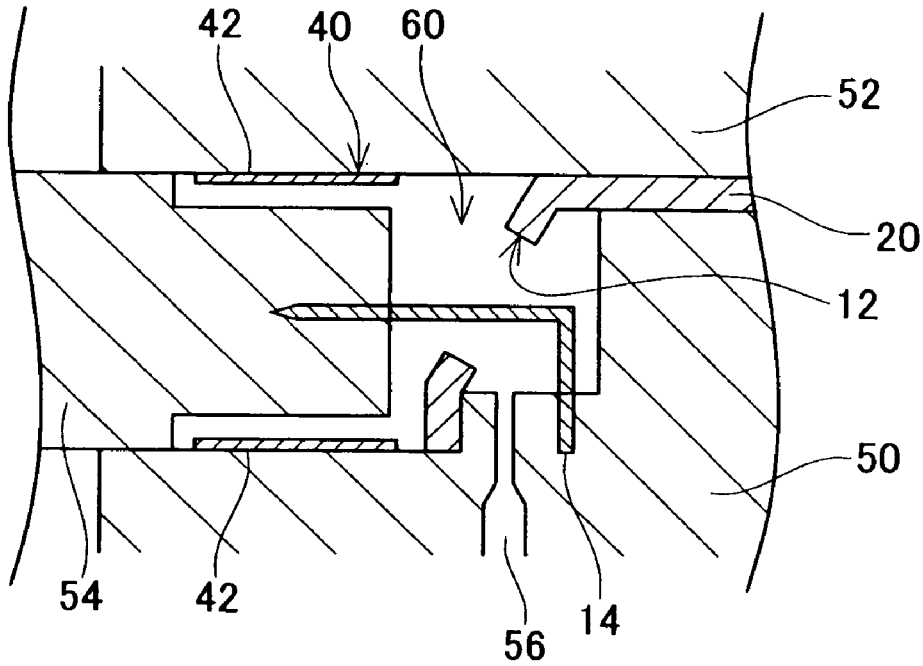
FIG. 8A shows a second manufacturing process of the connector case on the cross section taken along A-A line in FIG. 4.
Figure 8B:
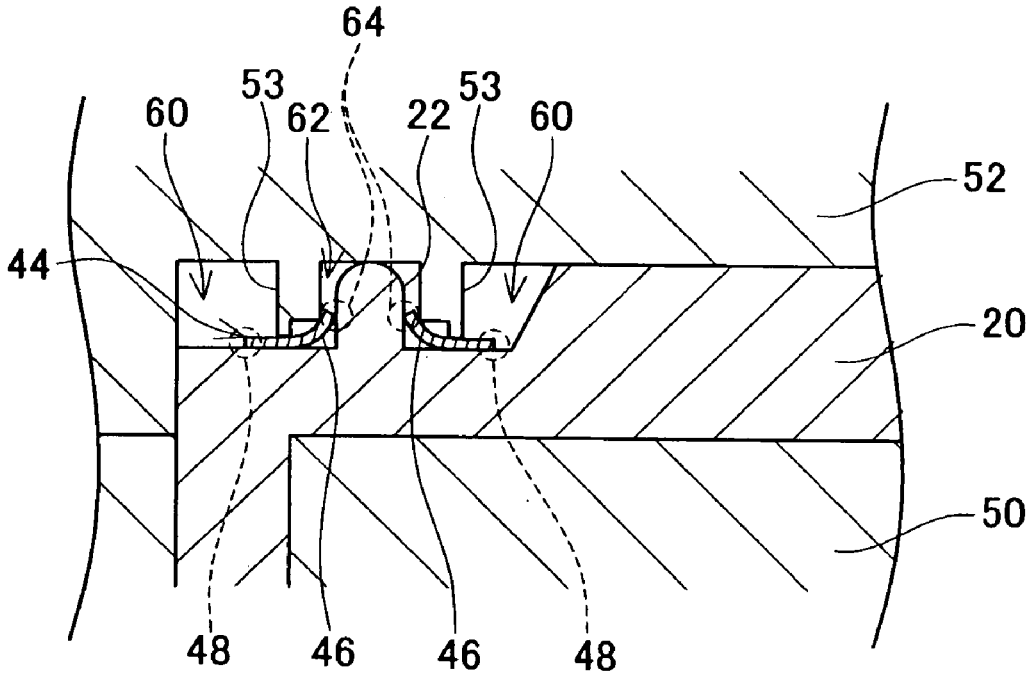
FIG. 8B shows the second manufacturing process on the cross section taken along B-B line in FIG. 4.
Figure 10:
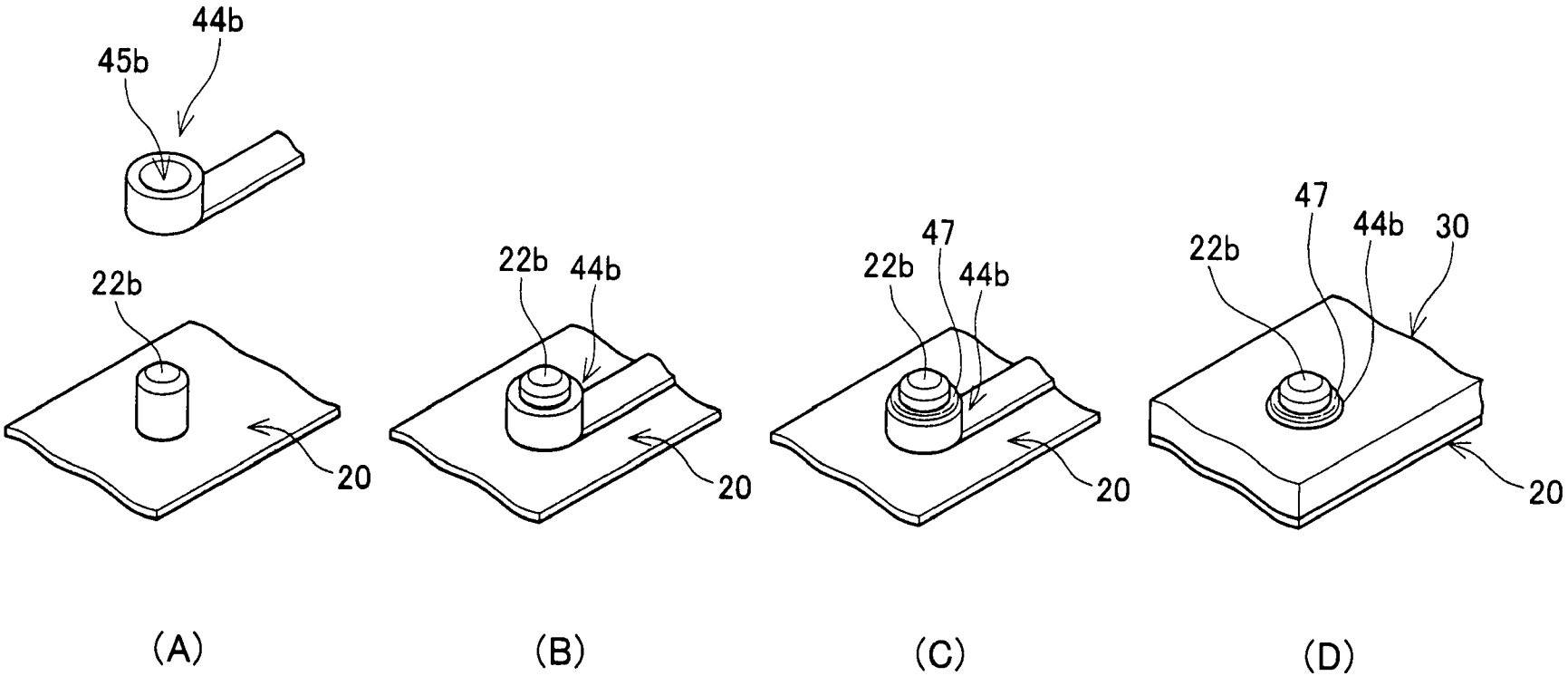
Figure 11:
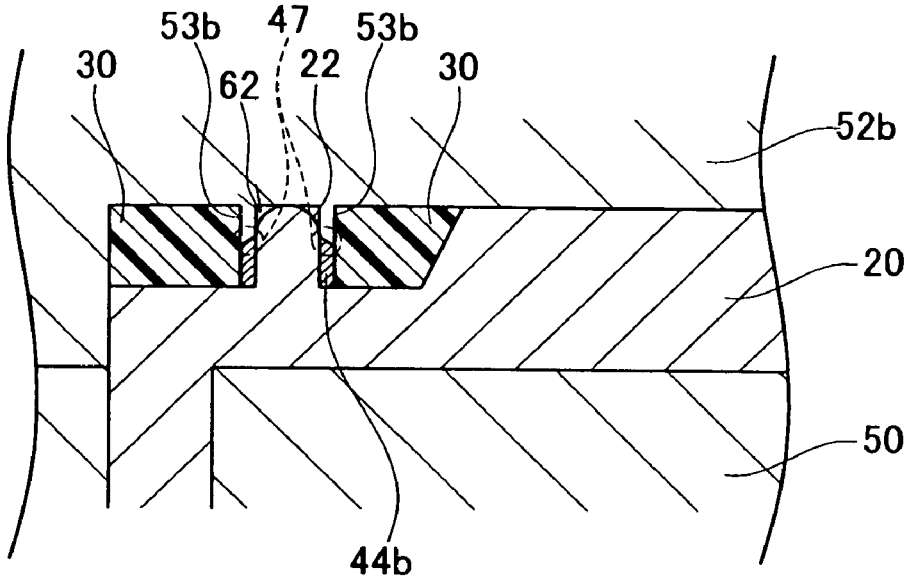
Figure 12:
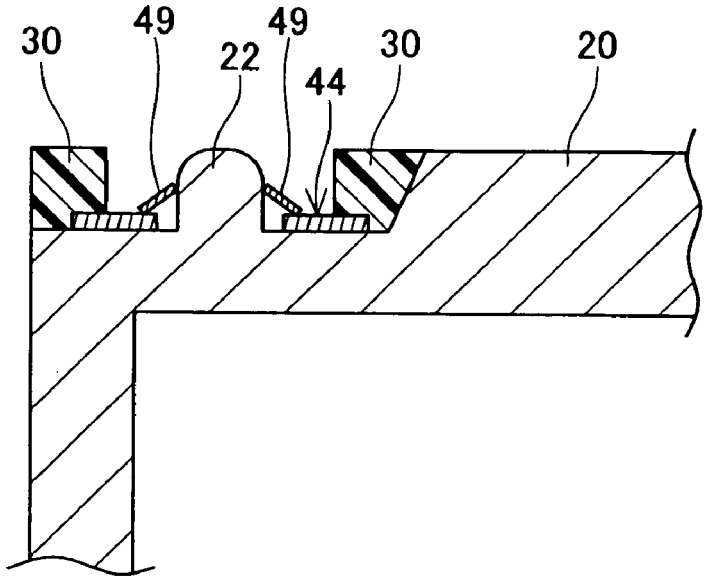
Figure 13:
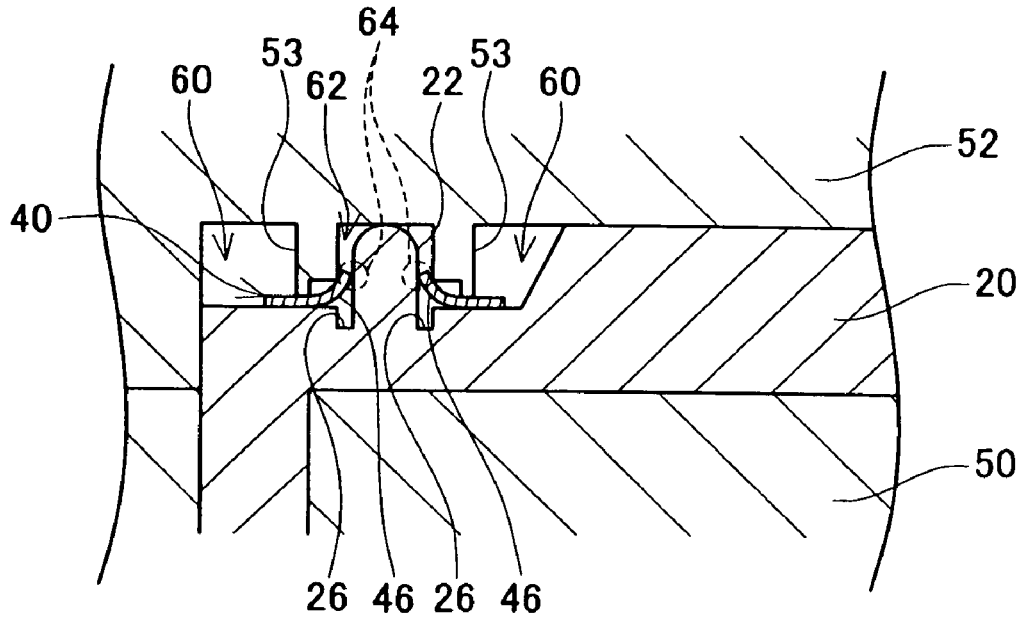
Figure 14:
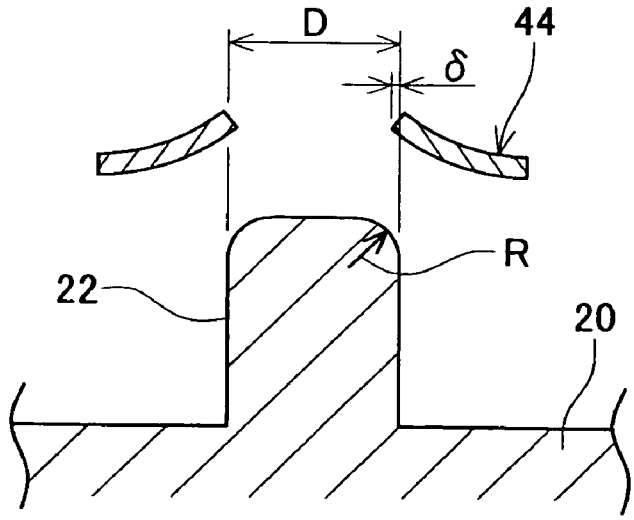
Figure 15:
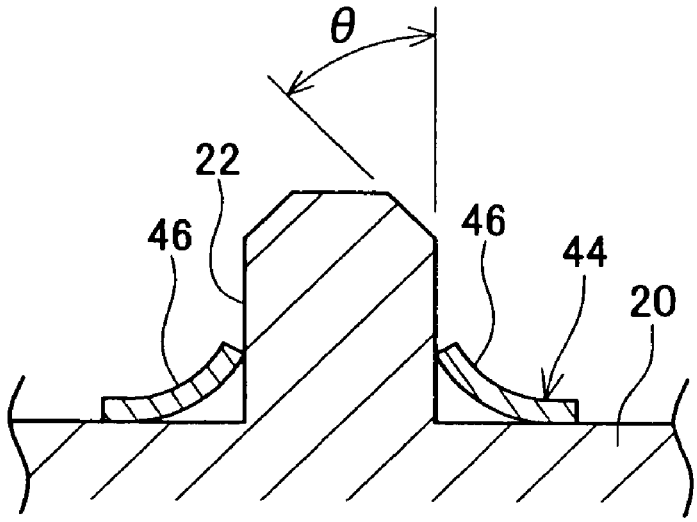
Figure 16:
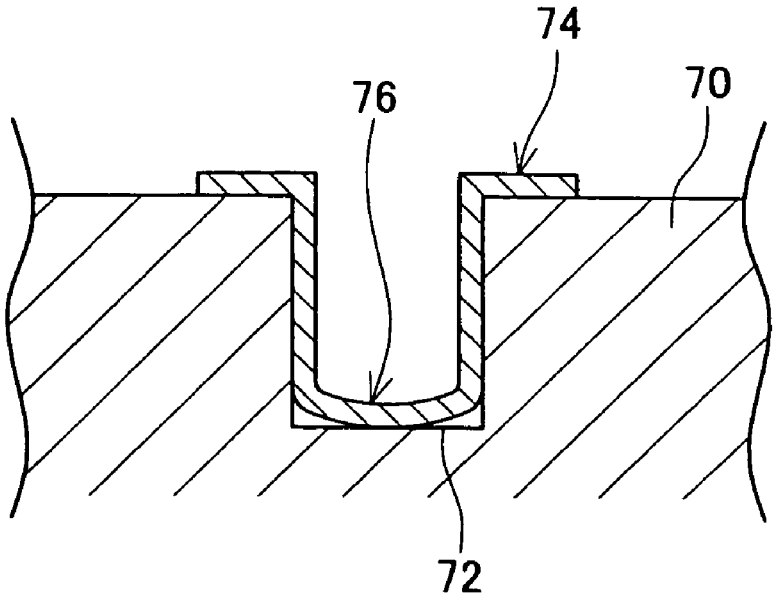

(A) in FIG. 10 shows an example of a shape of the terminal-side fixing portion;

(B) in FIG. 10 shows a state where the terminal-side fixing portion in the different shape is fit by insertion to a housing-side fixing portion;

(C) in FIG. 10 shows a state where the terminal-side fixing portion fitted by insertion to the housing-side fixing portion is crimped; and (D) in FIG. 10 shows a state where a periphery of the crimped terminal-side fixing portion is covered by the connector;

FIG. 11 describes a process for manufacturing the connector case by means of the terminal-side fixing portion in the different shape shown in FIG. 10;

FIG. 12 is a cross sectional view made on the plane and in the direction indicated by B in FIG. 4 when a crimping member independent to the terminal-side fixing portion of the ground terminal is used;

FIG. 13 is a view corresponding to FIG. 8B, and shows a case where a grooved portion is provided in a periphery of the housing-side fixing portion;

FIG. 14 shows an example where a top portion of the housing-side fixing portion is chamfered in a curved manner;

FIG. 15 shows an example where the top portion of the housing-side fixing portion is tapered; and FIG. 16 shows an example where the housing-side fixing portion is formed into a grooved shape.

DETAILED DESCRIPTION OF THE INVENTION

The present invention will be more clearly understood with reference to the accompanying drawings. Elements in the drawings are not necessarily drawn to scale, but are enhanced for illustrating principles of the present invention. Each numeral is common throughout all the drawings.

A description will now be given of embodiments of the present invention with reference to the drawings.

Figure 1:
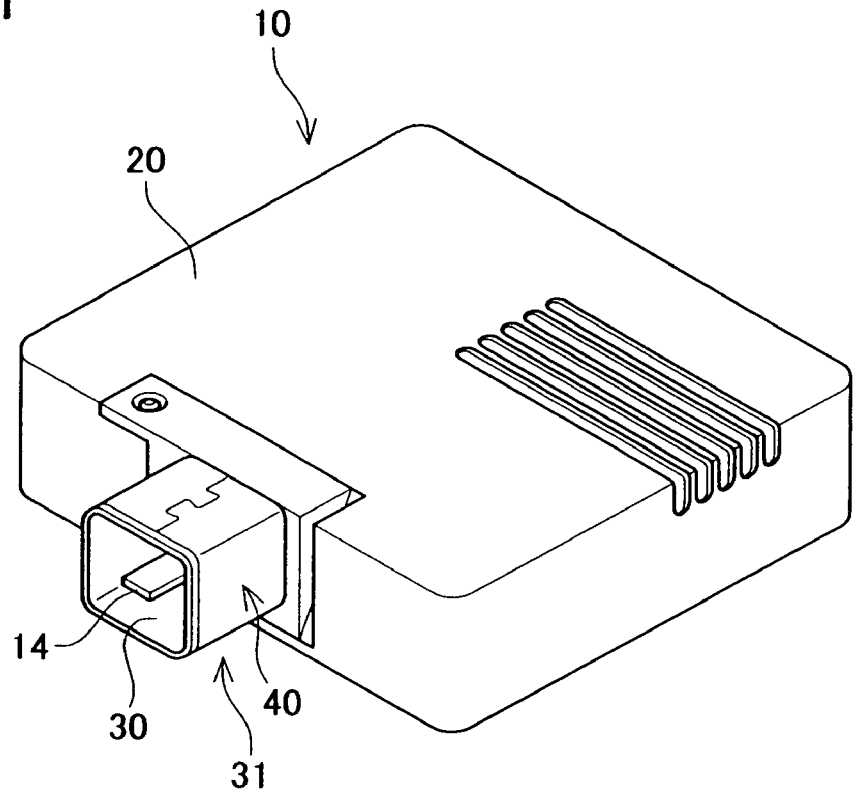
FIG. 1 is a schematic perspective view of a connector case according to a first embodiment.

<First Embodiment> A description will now be given of a case with a connector 10 according to a first embodiment with reference to FIGS. 1 to 5. The case 10 according to the present embodiment includes a housing-side connector portion 31 that is electrically connected to an external connector, which is not shown. In the following section, the case with a connector 10 is referred to as connector case 10. FIG. 1 is a schematic perspective view of the connector case 10.

The connector case 10 has a metal housing 20 and the housing-side connector portion 31. The housing-side connector portion 31 includes a metal ground terminal 40, a metal connection terminal 14, and a resin connector 30.

One end of the connection terminal 14 disposed outside the housing 20 is exposed inside the resin connector 30. The connection terminal 14 passes a through hole 12 (described with reference to FIG. 3) formed on the housing 20, enters the inside of the housing 20. The other end of the connection terminal 14 disposed inside the housing 20 is connected to a circuit board (not shown) disposed inside the housing 20. When the external connector (not shown) is connected to the housing-side connector portion 31, the connection terminal 14 comes in contact with a terminal (not shown) of the external connector, thereby electrically connecting to the terminal of the external connector to the circuit board.

The ground terminal 40 is connected to the metal housing 20. When the external connector is connected to the housing-side connector portion 31, the ground terminal 40 comes in contact with a terminal (not shown) of the external connector, thereby electrically connecting the terminal of the external connector to the housing. The ground terminal 40 includes a tubular shield portion 42 (described with reference to FIG. 2) which covers an outer periphery of the resin connector 30.

Figure 2:
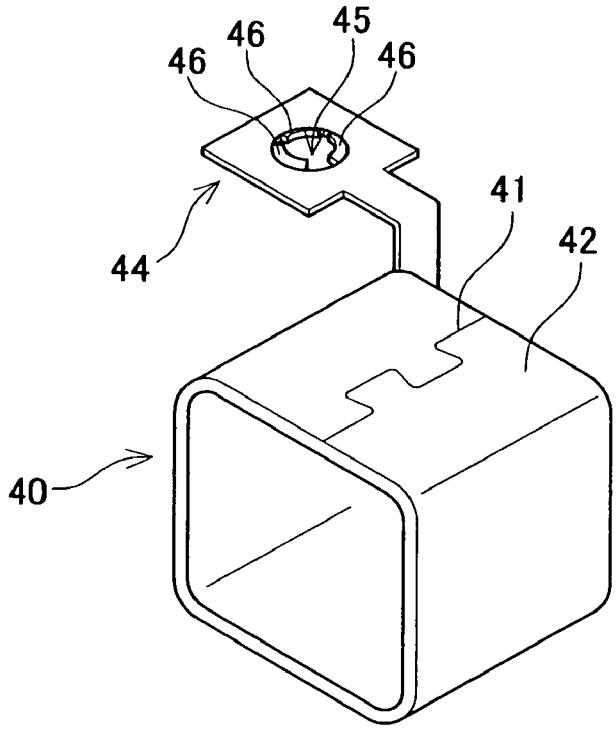
FIG. 2 is a schematic perspective view of a ground terminal.
Figure 3:
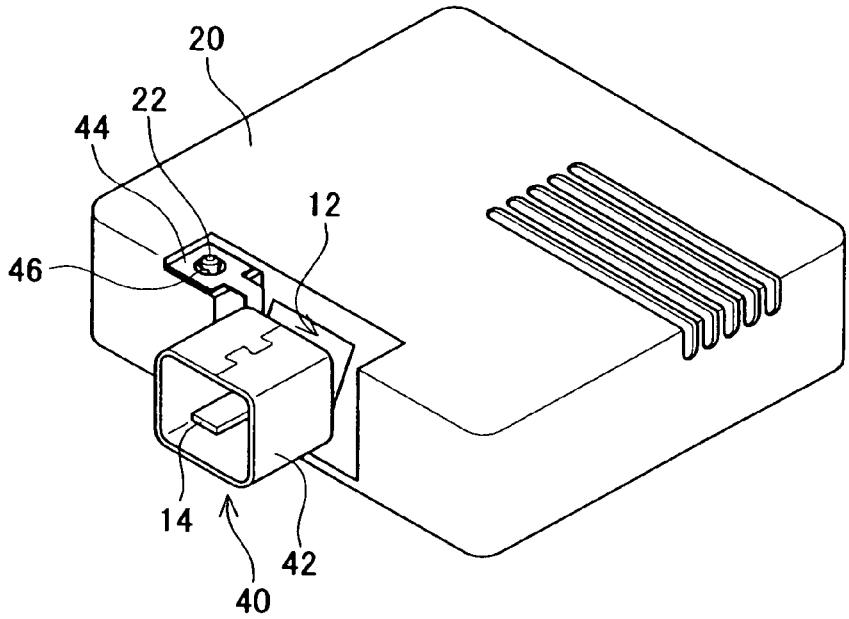
FIG. 3 shows a connector case without illustration of a connector.

FIG. 2 is a schematic perspective view of the ground terminal 40. The ground terminal 40 includes the shield portion 42 which is formed into a tubular shape along the outer periphery of the connector 30, and a terminal-side fixing portion 44 which extends from a rear end of the shield portion 42, and is fixed to the housing 20 as shown in FIG. 3. The housing 20 is kept to a ground electric potential level of the incorporated circuit when the connector case 10 is in use. Thus, when the connector case 10 is in use, the electric potential level of the housing 20 is equal to the ground electric potential level. The ground terminal 40 fixed to the housing 20 is also at the ground electric potential when the connector case 10 is in use. The shield portion 42 of the ground terminal 40 shields the connection terminal 14 in the connector 30 from external noises when the connector 10 is in use.

The ground terminal 40 is formed by pressing a sheet of metal as shown in FIG. 2. The shield portion 42 is formed into the tubular shape joined at a seam 41.

The terminal-side fixing portion 44 includes a fixing-portion hole 45. Prongs 46 for crimping are provided at three locations on the circumference of the fixing-portion hole 45.

FIG. 3 shows the connector case 10 shown in FIG. 1 without illustration of the resin connector 30.

A protruded housing-side fixing portion 22 is provided for fixing the ground terminal 40 on the housing 20. The fixing-portion hole 45 (refer to FIG. 2) provided on the terminal-side fixing portion 44 is fitted by insertion over the protruded housing-side fixing portion 22 on the housing 20. On this state, the prongs 46 for crimping provided along the circumference of the fixing-portion hole 45 are crimped to a side surface of the housing-side fixing portion 22.

The shield portion 42 of the ground terminal 40 is provided at a location extending along the through hole 12 provided on the housing 20 while the ground terminal 40 is fixed to the housing 20. The connection terminal 14 is provided approximately at the center of the tubular shield portion 42 of the ground terminal 40.

FIG. 4 shows a state where the connector portion 30 is formed in this state. FIG. 4 is an enlarged view of a periphery of the housing-side connector portion 31 of the connector case 10 shown in FIG. 1.

Figure 5A:
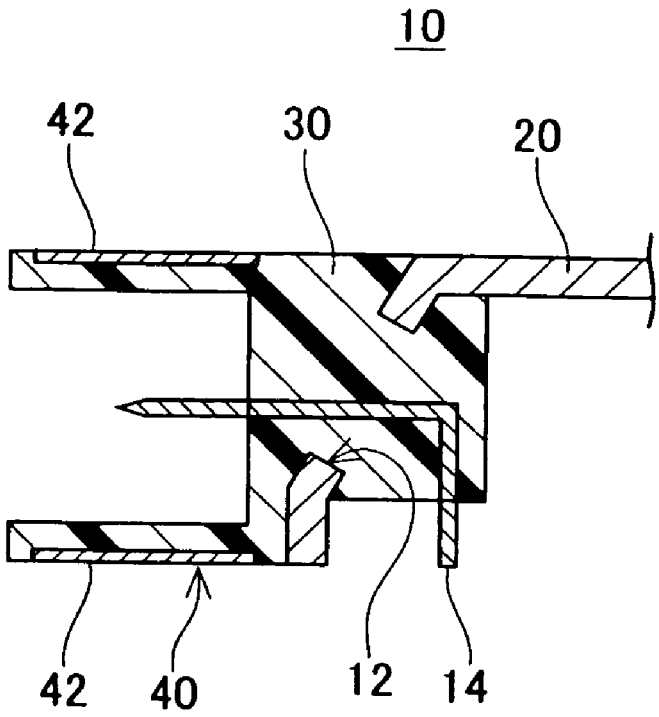
FIG. 5A is a cross sectional view taken along A-A line in FIG. 4.
Figure 5B:
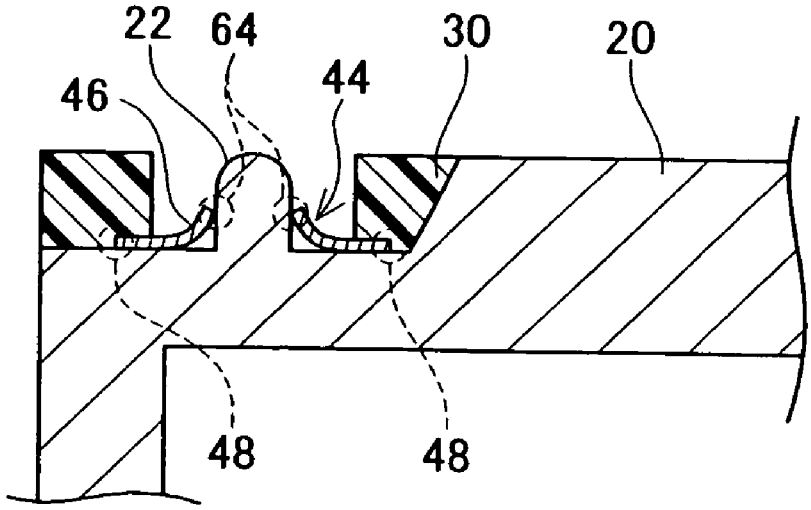
FIG. 5B is a cross sectional view taken along B-B line in FIG. 4.

FIG. 5A is a cross sectional view taken along A-A line in FIG. 4. FIG. 5B is a cross sectional view taken along B-B line in FIG. 4. For the sake of illustration, FIG. 5A and FIG. 5B illustrate only components which appear on the respective cross sections, and omit components which are disposed behind the cross sections.

The through hole 12 is provided on the housing 20 as shown in FIG. 3 and FIG 5A. The resin connector 30 covers the through hole 12, and extends from the through hole 12 toward the outside of the housing 20 along the inner periphery of the shield portion 42. Provided in the connector 30 is the connection terminal 14 used to electrically connect the terminal of the external connector (not shown) and the circuit (not shown) incorporated in the housing 20 with each other when the external connector is connected. As shown in FIG. 5A, the connection terminal 14 extends across the inside and the outside of the housing 20 passing the through hole 12 of the housing 20.

As shown in FIG 5B, the fixing-portion hole 45 (refer to FIG. 2) of the terminal-side fixing portion 44 is fit by insertion to the protruded housing-side fixing portion 22 provided on the housing 20. Crimping the prongs 46 to the side surface of the housing-side fixing portion 22 provides contact portions 64 between the prongs 46 and the housing-side fixing portion 22. The ground terminal 40 is also made of metal. The contact portions 64 electrically connect the ground terminal 40 and the metal housing 20 with each other.

The resin connector 30 extends not only along the through hole 12 of the housing 20, but also around the housing-side fixing portion 22 as shown in FIG. 4, FIG. 5A, and FIG. 5B. The resin forming the connector 30 covers fixing-portion peripheral portions 48 of the terminal-side fixing portion 44 as shown in FIG. 5B. The fixing-portion peripheral portions 48 are also in contact with the housing 20. These contact portions also electrically connect the ground terminal 40 and the metal housing 20.

The resin connector 30 fills a space formed between the connection terminal 14 and the housing 20 and between the connection terminal 14 and the ground terminal 40 as shown in FIG. 5A. The resin connector 30 is formed integrally with the housing 20, the ground terminal 40, and the connection terminal 14 as shown in FIG. 5A and FIG. 5B.

Since the non-conductive resin connector 30 is filled in the space, the resin connector 30 provides a function to insulate the housing 20 and the connection terminal 14 from each other as shown in FIG. 4 and FIG. 5A. Moreover, the resin connector 30 provides a function to insulate the connection terminal 14 and the ground terminal 40 from each other.

The resin forming the connector 30 covers the fixing-portion peripheral portions 48 of the terminal-side fixing portion 44, and the fixing-portion peripheral portions 48 are thus strongly pressed against the housing 20. As a result, the fixing-portion peripheral portions 48 of the ground terminal 40 and the housing 20 are close in contact with each other. The ground terminal 40 and the housing 20 are fixed to each other by means of crimping as well as the resin forming the connector 30. The ground terminal 40 and the housing 20 are more securely fixed to each other. The electrical connection between fixing-portion peripheral portions 48 (namely, the ground terminal 40) and the housing 20 is more secured at the same time.

The resin forming the connector 30 does not entirely cover the terminal-side fixing portion 44 and the prongs 46 as shown in FIG. 4 and FIG. 5B. Even after the connector case 10 is completed, it is possible to visibly inspect the condition of the contact portions 64 between the prongs 46 and the housing-side fixing portion 22.

The ground terminal 40 and the housing 20 are electrically connected with each other. Thus, when the external connector (not shown) is connected to the housing-side connector portion 31, an external-connector shield portion (not shown) extending along the inner periphery of the external connector is connected to the shield portion 42 extending along the outer periphery of the housing-side connector portion 31. The shield portion 42 is kept to the same electric potential as that of the ground. The external connector shield portion (not shown) thus is kept to the same ground electric potential. A cable (not shown) in the external connector, the connection terminal 14 for transmitting/receiving a signal, and the circuit (not shown) incorporated into the housing 20 are covered by the shield portion 42 and the housing 20 at the ground electric potential. With this configuration, it is possible to shield the connection terminal 14 and the circuit (not shown) incorporated in the housing 20 from an external electric field. Moreover, conversely, it is possible to prevent the electric signal and the power passing the connection terminal 14 from emitting noises to the outside.

According to the above embodiment, the contact portions 64 at which the terminal-side fixing portion 44 and the housing-side fixing portion 22 are in contact with each other are exposed. It is possible to inspect the connecting condition between the terminal-side fixing portion 44 and the housing-side fixing portion 22 by exposing the contact portions 64 even after the connector case 10 is completed.

Moreover, the different portions of the contact portions 64, namely, the fixing-portion peripheral portions 48 of the terminal-side fixing portion 44 are covered with the resin forming the connector 30. Covering the fixing-portion peripheral portions 48 with the resin more surely secures the electrical connection between the ground terminal 40 and the housing 20 at the contact portions between the fixing-portion peripheral portions 48 and the housing 20.

It should be noted that the terminal-side fixing portion 44 is crimped to the housing-side fixing portion 22 by means of the prongs 46 in the above embodiment. In place of crimping, the ground terminal 40 may be fixed to the housing 20 by pressing the prongs 46 over the housing-side fixing portion 22.

<Second Embodiment> A description will now be given of a second embodiment of the present invention. This second embodiment is a manufacturing method of the connector case 10 shown in FIG. 1. According to the manufacturing method of this connector case 10, the connector 30 is manufactured by means of insert molding by arranging the preformed housing 20, the preformed connection terminal 14, and the preformed ground terminal 40 in a mold, and, then, injecting the resin into the cavity formed inside the molds. The housing 20 is formed by aluminum die casting, for example. The connection terminal 14 and the ground terminal 40 are formed by pressing from a sheet material such as C2600. After the connection terminal 14 and the ground terminal 40 are formed by pressing, tin plating is applied, for example.

FIG. 6 to FIG. 9 show the manufacturing method. FIG. 6A, FIG. 7A, FIG. 8A, and FIG. 9A show manufacturing processes for the portion corresponding to the cross section of the connector case 10 shown in FIG. 5A. FIG. 6B, FIG. 7B, FIG. 8B, and FIG. 9B show manufacturing processes for the portion corresponding to the cross section of the connector case 10 shown in FIG. 5B. It should be noted that FIG. 5A is a cross sectional view taken along A-A line shown in FIG. 4, and FIG. 5B is a cross sectional view taken along B-B line shown in FIG. 4. For the sake of illustration, FIG. 6 to FIG. 9 illustrate only components which appear on the respective cross sections, and omit components which are disposed behind the cross sections.

[First Manufacturing Process (A)] The housing 20, the connection terminal 14, and the ground terminal 40 are placed in the molds in a first manufacturing process. For the sake of description, a process for placing the housing 20 in the molds is referred to as first manufacturing process (A), and a process for placing the connection terminal 14 and the ground terminal 40 in the molds is referred to as first manufacturing process (B).

Figure 6A:
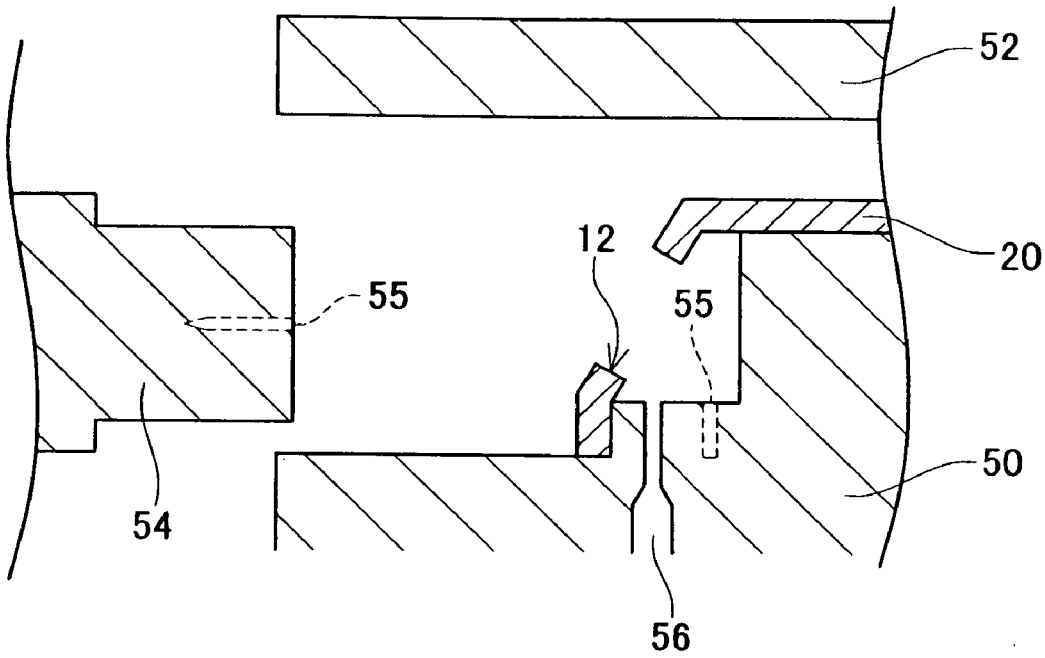
FIG. 6A shows a first manufacturing process (A) of the connector case on the cross section taken along A-A line in FIG. 4.
Figure 6B:
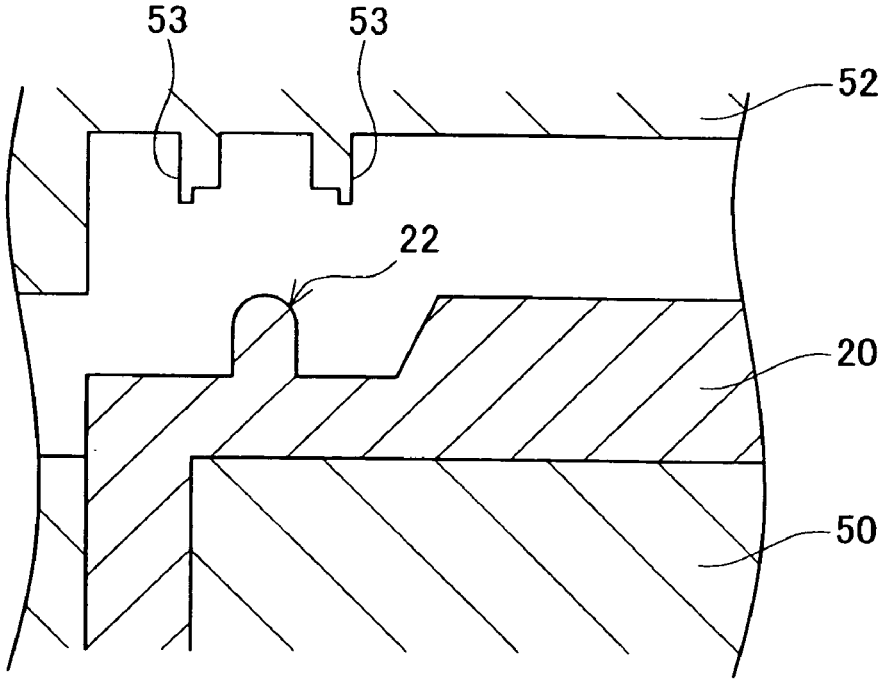
FIG. 6B shows the first manufacturing process (A) of the connector case on the cross section taken along B-B line in FIG. 4.

FIG. 6A and FIG. 6B show the first manufacturing process (A) of the connector case 10. The housing 20 is placed on a first mold 50 as shown in FIG. 6A and FIG. 6B.

The molds include the first mold 50, a second mold 52, and a slide mold 54. The second mold 52 and the slide mold 54 are disposed at the positions apart from the first mold 50 serving as a base so that the housing 20, the connection terminal 14 (not shown in FIG. 6A and FIG. 6B), and the ground terminal 40 (not shown in FIG. 6A and FIG. 6B) can be placed on the first mold 50.

FIG. 6A is a cross sectional view taken along A-A line shown in FIG. 4, and shows the portion at which the resin connector 30 (FIG. 1) is formed. The resin connector 30 (FIG. 1) extends from the through hole 12 of the housing 20 toward the outside of the housing 20. The slide mold 54 is a mold used to form the portion of the resin connector 30 extending toward the outside of the housing 20.

A resin injection nozzle 56 is provided on the first mold 50 in order to inject the molten resin after the molds are closed and the cavity is formed. Connection-terminal grooves 55 are provided on the first mold 50 and the slide mold 54 in order to place the connection terminal 14 later.

FIG. 6B is a cross sectional view taken along B-B line shown in FIG. 4, and the housing-side fixing portion 22 is provided on the housing 20. A pressing portion 53 is provided at a position on the inner surface of the second mold 52 corresponding to the housing-side fixing portion 22.

The housing-side fixing portion 22 is formed into an approximately cylindrical shape (into a protruded shape), and the pressing portion 53 formed on the second mold 52 is formed into a tubular shape surrounding this cylindrical housing-side fixing portion 22 as shown in FIG 3. The pressing portion 53 provides a function for crimping the prongs 46 of the terminal-side fixing portion 44 positioned corresponding to the housing-side fixing portion 22 later when the molds are closed while the second mold 52 is pressed against the first mold 50.

[First Manufacturing Process (B)] The first manufacturing process (B) is a process to place the ground terminal 40 and the connection terminal 14 on the molds subsequently to the first manufacturing process (A).

Figure 7A:
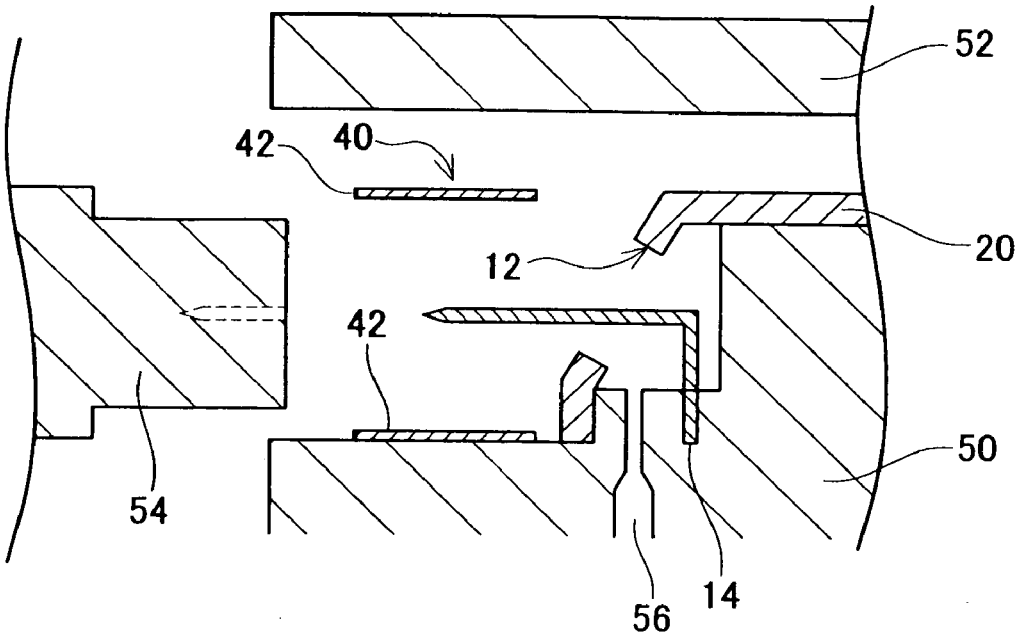
FIG. 7A shows a first manufacturing process (B) of the connector case on the cross section taken along A-A line in FIG. 4.
Figure 7B:
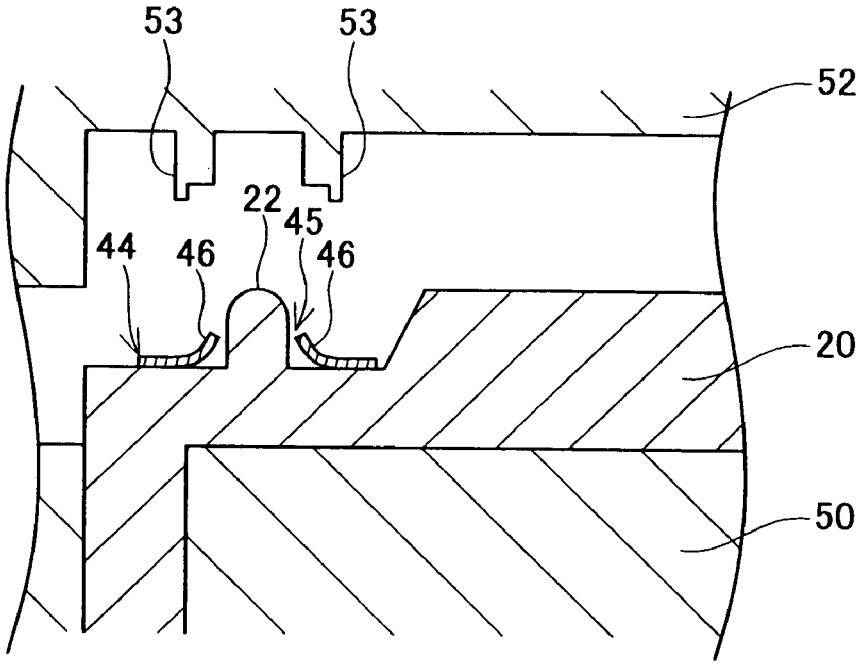
FIG. 7B shows the first manufacturing process (B) of the connector case on the cross section taken along B-B line in FIG. 4.

FIG. 7A and FIG. 7B show the first manufacturing process (B). The ground terminal 40 is placed such that the shield portion 42 of the ground terminal 40 is placed on the outer periphery of the portion of the connector 30 extending toward the outside of the through hole 12 of the housing 20 as shown in FIG. 7A. It should be noted that FIG. 6 to FIG. 9 omit components which are disposed behind the cross sections as described before. The shield portion 42 appearing as upper and lower two portions in FIG. 7A is formed into the tubular shape, and the upper and lower portions are connected with each other behind the cross section in FIG. 7A.

The ground terminal 40 is placed, and, at the same time, the connection terminal 14 is placed in the terminal grooved portion 55 of the first mold 50.

The ground terminal 40 is placed on the first mold 50 while the terminal-side fixing portion 44 of the ground terminal 40 is aligned to the housing-side fixing portion 22 on the cross section taken along B-B line shown in FIG. 4 as shown in FIG. 7B. In other words, the ground terminal 40 is placed on the first mold 50 while the fixing-portion hole 45 provided on the terminal-side fixing portion 44 is inserted over the housing-side fixing portion 22. The prongs 46 are provided on the inner circumference of the fixing-portion hole 45 of the terminal-side fixing portion 44.

It should be noted that FIG. 7A and FIG. 7B show the state where the one housing 20 and the one ground terminal 40 are placed on the one mold 50 on the different cross sections. The ground terminal 40, the housing 20, and the first mold 50 are formed such that there is no inconsistency between that the shield portion 42 is placed on the outer periphery of the portion extending toward the outside of the through hole 12 of the housing 20 as shown in FIG. 7A and that the ground terminal 40 is placed on the first mold 50 while the terminal-side fixing portion 44 is aligned to the housing-side fixing portion 22 as shown in FIG. 7B.

[Second Manufacturing Process] A second manufacturing process is a process for closing the molds by means of the first mold 50, the second mold 52, and the slide mold 54, namely a process for mold clamping.

FIG. 8A and FIG. 8B show the second manufacturing process. The second mold 52 is moved downward in the drawing, and the slide mold 54 is moved rightward in the drawing as shown in FIG. 8A. As a result, the molds are closed. When the molds are closed, the cavity 60 is formed inside.

When the second mold 52 moves downward, the pressing portion 53 provided on the second mold 52 presses down tips of the prongs 46 of the ground terminal 40 as shown in FIG. 8B. The prongs 46 are crimped to the housing-side fixing portion 22 by the tips of the prongs 46 being pressed down. The second mold 52 is pressed against to the first mold 50 with a strong force in order to resist a high pressure of the molten resin to be subsequently injected into the cavity 60. The force to press the second mold 52 against the first mold 50 securely crimps the prongs 46 to the housing-side fixing portion 22. Namely, the pressing portion 53 formed on the second mold 52 is pressed against the terminal-side fixing portion 44 and the prongs 46, and pressing the terminal-side fixing portion 44 and the housing-side fixing portion 22 against each other in the second manufacturing process. As a result, the terminal-side fixing portion 44 and the housing-side fixing portion 22 are fixed to each other by crimping, and the molds are closed to form the cavity 60 in the second manufacturing process.

The prongs 46 and the housing-side fixing portion 22 will have the contact portions 64 as a result of the crimping. The contact portions electrically connect the ground terminal 40 and the housing 20 with each other. Moreover, the pressing portion 53 on the second mold 52 presses the entire terminal-side fixing portion 44 against the housing 20. The fixing-portion peripheral portions 48 of the terminal-side fixing portion 44 are strongly pressed against the housing 20. The ground terminal 40 and the housing 20 are electrically connected with each other also by the fixing-portion peripheral portions 48.

The cavity 60 shown in FIG. 8A forms the same space as the cavity 60 shown in FIG. 8B. A fixing space 62 surrounded by the pressing portion 53 on the second mold 52, the terminal-side fixing portion 44, and the housing-side fixing portion 22 is separated from the cavity 60 as shown in FIG. 8B. In other words, when the molten resin is injected into the cavity 60, the molten resin will not flow in the fixing space 62.

Figure 9A:
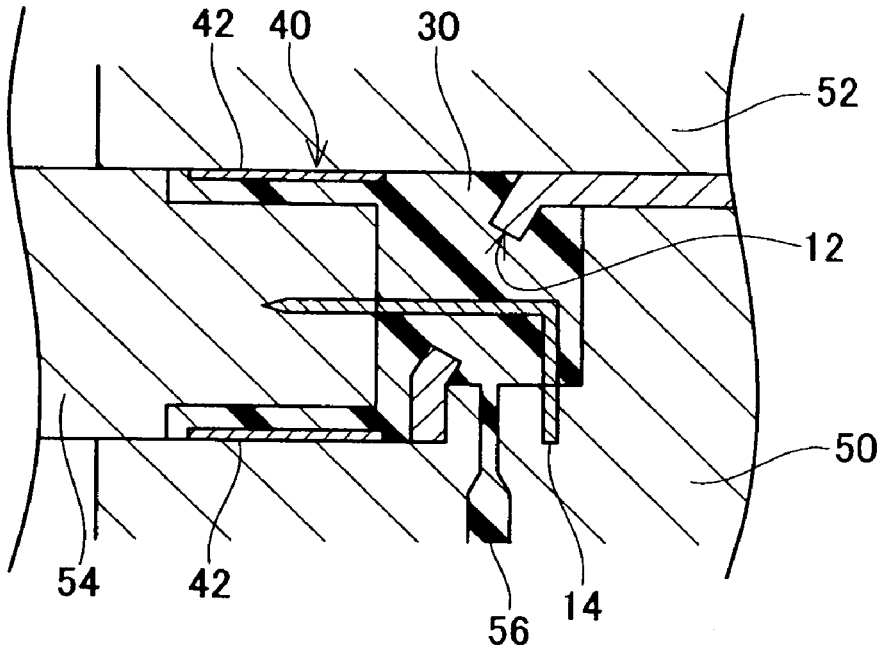
FIG. 9A shows a third manufacturing process of the connector case on the cross section taken along A-A line in FIG. 4.
Figure 9B:
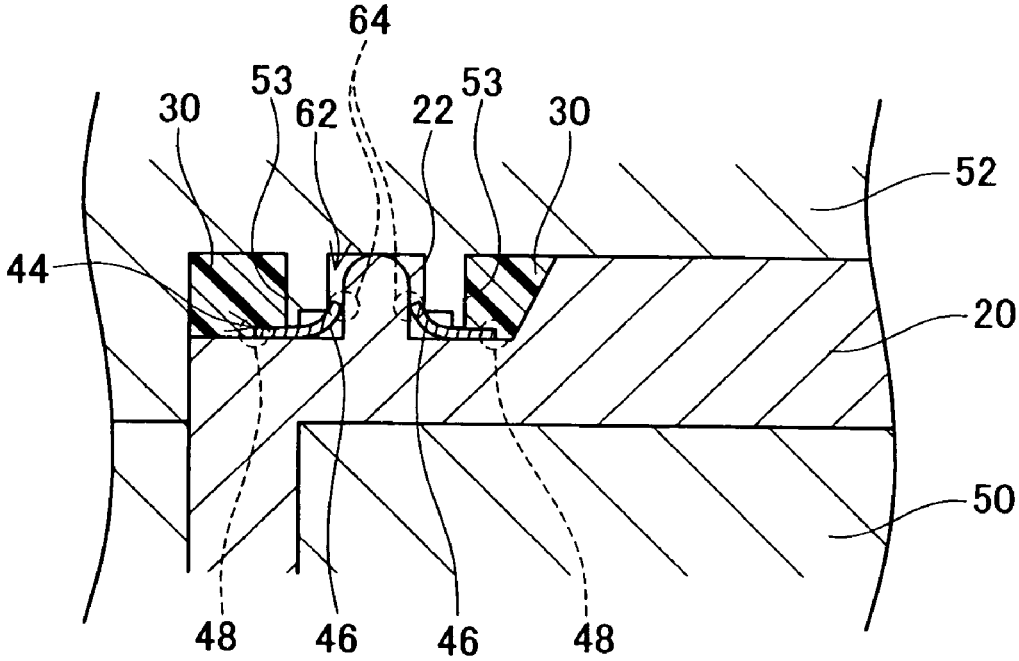
FIG. 9B shows the third manufacturing process on the cross section taken along B-B line in FIG. 4.

[Third Manufacturing Process] A third manufacturing process is a process for injecting the molten resin into the cavity 60 formed in the molds to form the connector 30. FIGS. 9A and 9B show the third manufacturing process. The connector 30 is formed by injecting the molten resin from the resin injection nozzle 56 into the cavity 60 shown in FIG. 8A as shown in FIG. 9A. The connector 30 is formed along the shield portion 42 of the ground terminal 40.

As shown in FIG. 9A, the resin connector 30 fills the space formed between the connection terminal 14, the housing 20, and the ground terminal 40, namely the cavity 60 shown in FIG. 8A. The resin connector 30 is formed integrally with the housing 20, the ground terminal 40, and the connection terminal 14. The housing-side connector portion 31 (refer to FIG. 1) including the ground terminal 40, the metal connection terminal 14, and the resin connector 30 is formed in this way.

The housing 20 and the connection terminal 14 are fixed in the insulated condition by means of the injection molding of the non-conductive resin connector 30 in the cavity 60. Moreover, the connection terminal 14 and the ground terminal 40 are fixed in the insulated condition.

The cavity 60 shown in FIG. 8A and the cavity 60 shown in FIG. 8B form the same space as described with reference to FIGS. 8A and 8B. The connector portion 30 covers the housing 20 and the fixing-portion peripheral portions 48 as shown in FIG. 9B.

Moreover, since the fixing space 62 and the cavity 60 are separated from each other, the injected molten resin will not flow into the fixing space 62. In other words, the contact portions 64 between the housing-side fixing portion 22 and the prongs 46 of the terminal-side fixing portion 44 are not covered with the resin in the fixing space 62.

When the molten resin is solidified, the second mold 52 is moved upward in the drawing, and the slide mold 54 is moved leftward in the drawing. Namely, the molds are opened. In this way, the connector case 10 having the resin connector 30 and the ground terminal 40 which is fixed to the housing-side fixing portion 22 is completed. Here, the ground terminal 40 has the shield portion 42 extending along the outer periphery of the resin connector 30.

The above manufacturing method provides the following advantages.

(1) The ground terminal 40 is crimped to the housing 20 when the molds are closed. The process to fix the ground terminal 40 to the housing 20 can be carried out in the series of processes of the injection molding of the housing-side connector portion 30. The resin connector 30 is formed integrally with the metal housing 20, and it is possible to increase the reliability of the connector case l0, which can maintain the electric potential of the external device equal to the electric potential of the housing upon connecting the external device to the ground terminal 40. Moreover, it is possible to manufacture the reliable connector case 10 efficiently with a small number of processes.

(2) When the molten resin is injected, the terminal-side fixing portion 44 (including the fixing-portion peripheral portions 48 and the prongs 46) is maintained as it is pressed against the housing by the pressing portion 53 of the second mold 52 in the third manufacturing process. It is possible to prevent the terminal-side fixing portion 44 from detaching from the housing 22 even if the pressure of the injected molten resin or influence of plastic deformation of the resin when the resin is solidified is exerted. It is possible to secure the fixing and the electrical connection between the ground terminal 40 and the housing 20.

(3) The ground terminal 40 is crimped to the protruded housing-side fixing portion 22 of the housing 20 by the prongs 46 of the ground terminal 40. The prongs 46 electrically connect the ground terminal 40 and the housing 20. The prongs 46 of the ground terminal 40 bite into the housing 20 as a result of the crimping. Non-conductive layers such as oxide layers are hardly formed on the contact portions 64 between the prongs 46 and the housing-side fixing portion 22. It is possible to increase durability of the electrical connection between the ground terminal 40 and the housing 20. Moreover, even if a non-conductive layer is formed either on the ground terminal 40 or the housing 20 before the ground terminal 40 is fixed to the housing 20, since the prongs 46 bite into the housing 20, the non-conductive layers can be removed.

(4) The fixing-portion peripheral portions 48 are strongly pressed to the housing 20 by the resin at a high pressure on forming the connector 30. The ground terminal 40 and the housing 20 are fixed to each other, and are electrically connected with each other by the contact between the fixing-portion peripheral portions 48 and the housing 20. Since the contact portions are provided between the housing 20 and the ground terminal 40 in addition to the prongs 46, it is possible to more surely secure the fixing and the electrical contact between the ground terminal 40 and the housing 20.

(5) The resin forming the connector 30 will not flow into the fixing space 62. The contact portions 64 between the housing-side fixing portion 22 and the prongs 46 of the terminal-side fixing portion 44 are not covered with the resin in the fixing space 62. The molten resin will not enter between the prongs 46 and the housing-side fixing portion 22. Moreover, the prongs 46 which have been crimped are not influenced by the plastic deformation of the resin when the resin is bonded. It is possible to more surely secure the fixing and the electrical connection between the prongs 46, namely the ground terminal 40, and the housing 20.

(6) Since the contact portions 64 between the housing-side fixing portion 22 and the prongs 46 of the terminal-side fixing portion 44 are not covered with the resin, the contact condition of the contact portions 64 can be checked after the connector case 10 is manufactured.

A description will now be given of variations of the connector case 10 according to the first embodiment, and the manufacturing method of the connector case 10.

According to the above embodiments, the terminal-side fixing portion 44 is crimped to the protruded housing-side fixing portion 22. The diameter of the fixing-portion hole 45 of the terminal-side fixing portion 44 may be formed smaller than the diameter of the protruded housing-side fixing portion 22, and the terminal-side fixing portion 44 may be pressed over the protruded housing-side fixing portion 22. Even in this case, the terminal-side fixing portion 44 can be pressed over the protruded housing-side fixing portion 22 by the pressing portion 53 provided on the second mold 52 in the second manufacturing process shown in FIG. 8. In this case, the shape of the pressing portion 53 provided on the second mold 52 may be configured so as to be suitable for the press-in. Specifically, the pressing portion 53 may be formed into a cylindrical shape which can be inserted over the protruded housing-side fixing portion 22 with a predetermined clearance. When the terminal-side fixing portion 44 is pressed over the protruded housing-side fixing portion 22, it is possible to remove non-conductive layers such as oxide layers which have already been emerged on the terminal-side fixing portion 44 or the housing-side fixing portion 22 before fixing, by the sliding between the terminal-side fixing portion 44 and the housing-side fixing portion 22 upon the press-in.

Moreover, the prongs 46 are provided on the terminal-side fixing portion 44 according to the above embodiments. The prongs 46 are crimped to the protruded housing-side fixing portion 22. In place of this configuration, the prongs 46 may not be provided, and the protruded housing-side fixing portion 22 may be crushed to crimp the ground terminal 40 to the housing 20. In this case, the shape of the pressing portion 53 on the second mold 52 shown in FIG, 6B may be changed accordingly. In this case, the shape of the pressing portion 53 may be changed into a shape which crushes a top portion of the housing-side fixing portion 22 when the second mold 52 is pressed against the first mold 50.

FIG. 10 shows an example of the alternative of the terminal-side fixing portion.

The terminal-side fixing portion 44*b* may be formed into a tubular shape as shown in (A) in FIG. 10. The tubular terminal-side fixing portion 44*b* has a fixing-portion hole 45*b*. A housing-side fixing portion 22*b* is formed into an approximately cylindrical shape as the housing-side fixing portion 22 of the above embodiments.

The tubular terminal-side fixing portion 44*b* is fitted by insertion to the cylindrical housing-side fixing portion 22*b* provided on the housing 20 as shown in (B) in FIG. 10. This is carried out in the first manufacturing process (B) described according to the second embodiment.

The tubular terminal-side fixing portion 44*b* is crimped to the housing-side fixing portion 22*b* to form a crimped portion 47 as shown in (C) in FIG. 10. This is carried out in the second manufacturing process described according to the second embodiment. After the crimping, the resin connector 30 is formed by injection molding so as to cover the entire periphery of the tubular terminal-side fixing portion 44*b* as shown in (D) in FIG. 10. This is carried out in the third manufacturing process described according to the second embodiment. On this occasion, the resin connector 30 is formed by injection molding so as to expose the crimped portion 47. As a result of this injection molding, the entire periphery of the tubular terminal-side fixing portion 44*b* is bonded by the resin of the connector 30. As a result, it is possible to prevent the crimped portion 47 from loosening. Moreover, since the crimped portion 47 is exposed, it is possible to check the condition of the crimped portion 47 after the connector case is manufactured.

With reference to FIG. 11, a description will now be given of a process for manufacturing the variation described with reference to FIG. 10. FIG. 11 corresponds to FIG. 8B and FIG. 9B according to the second embodiment.

In this variation, a pressing portion 53*b* is formed at a position on an inner surface of a second mold 52*b* corresponding to the terminal-side fixing portion 44*b* of the ground terminal placed on the first mold 50. When the molds are closed in the second manufacturing process, the pressing portion 53*b* presses the terminal-side fixing portion 44*b* to the housing-side fixing portion 22. The pressing force forms the crimped portion 47 above the terminal-side fixing portion 44*b*. The molten resin is then injected into a cavity (portion where the connector 30 is formed in FIG. 11) to form the connector 30 in the third manufacturing process. The molten resin will not flow into the pressing portion 53*b* and the fixing space 62. The crimped portion 47 thus can be exposed as shown in (D) in FIG. 10.

It should be noted that an upper portion of the terminal-side fixing portion 44*b*, the crimped portion 47, and an upper portion of the housing-side fixing portion 22 are protruded above a surface of the resin connector 30 in FIG. 10D. On the other hand, the surface of the connector 30 and the top portion of the housing-side fixing portion 22 have the same level in the cross sectional view shown in FIG. 11. (D) in FIG. 10 and FIG. 11 do not match each other. This is because (D) in FIG. 10 is drawn to clearly show that the crimped portion 47 is exposed, and FIG. 11 is drawn as close to FIG. 8B and FIG. 9B as possible. It is possible to form the second mold 52*b* in FIG. 11 to realize the shape shown in (D) in FIG 10. Conversely, it is also possible to manufacture the connector case with the exposed crimped portion 47 by means of the second mold 52*b* in the shape shown in FIG. 11.

Crimping members 49 may be additionally provided as shown in FIG. 12 in place of the prongs 46 for crimping (refer to FIG. 2) provided on the terminal-side fixing portion 44. As a result, the terminal-side fixing portion 44 is not deformed as a result of crimping. It is thus possible to prevent a residual stress from being generated in the terminal-side fixing portion 44. It is thus possible to prevent the residual stress generated in the terminal-side fixing portion 44 from influencing the resin of the connector 30. A press-in member (not shown) in place of the crimping member 49 may be pressed over the housing-side fixing portion 22 above the terminal-side fixing portion 44. It is possible to prevent a residual stress from being generated in the terminal-side fixing portion 44 also by means of the pressing member.

As shown in FIG. 13, a grooved portion 26 may be provided around the foot of the protruded housing-side fixing portion 22. FIG. 13 corresponds to FIG. 8B according to the second embodiment. The components that are referred in FIG. 8B have the same numerals in FIG. 13. It is possible by providing the grooved portion 26 to store shavings generated when the terminal-side fixing portion 44 is crimped to or pressed over the housing-side fixing portion 22 in the grooved portion 26. On this occasion, it is possible to blow off the shavings stored in the grooved portion 26 by blowing the air after the housing-side connector portion 30 is formed by the injection molding. It is thus possible to prevent the shavings from entering between the ground terminal 40 and the housing 20.

As shown in FIG. 14, when the terminal-side fixing portion 44 of the ground terminal 40 (the ground terminal is not shown in FIG. 14) is pressed over the approximately cylindrical (protruded) housing-side fixing portion 22 provided on the housing 20, a peripheral portion of the top portion of the approximately cylindrical housing-side fixing portion 22 is preferably chamfered. A relationship among a chamfer radius R, the diameter D of the hole of the housing-side fixing portion 22, and the press-in interference dimension δ preferably satisfies $\delta < R \leqq D/2$. As a result, it is possible to increase an insertion capability of the press-in portion. It is possible to prevent the press-in portion from being crushed, flawed, or buckled when the terminal-side fixing portion 44 is pressed over the housing-side fixing portion 22.

Alternatively, the press-in interference δ of the press-in portion may be set such that a relationship $0.05 \leqq \delta <$ displacement magnitude corresponding to the stress limit of the press-in portion is met. It is possible to effectively remove non-conductive layers such as oxide layers which have been emerged on the terminal-side fixing portion 44 or the housing-side fixing portion 22 by a graze upon the press-in when the interference dimension δ is set in this way.

As shown in FIG. 14, when the terminal-side fixing portion 44 of the ground terminal 40 (the ground terminal 40 is not shown in FIG. 15) is pressed over the approximately cylindrical housing-side fixing portion 22 provided on the housing 20, the top portion of the approximately cylindrical housing-side fixing portion 22 may be tapered. On this state, an angle θ between the side surface of the housing-side fixing portion 22 and the tapered surface preferably satisfies a relationship $10° \leqq \theta \leqq 45°$. When the angle $\theta$ is set in this range, it is possible to prevent the press-in portion from being crushed, flawed, or buckled upon the press-in.

According to the above embodiments and the variation thereof, the housing-side fixing portion 22 is formed into the approximately cylindrical protrusion. As shown in FIG. 16, a housing-side fixing portion 72 formed into a grooved shape may be provided on the housing 70. In this case, a terminal-side fixing portion 74 of the ground terminal (the ground terminal is not shown in FIG. 16) may be formed into a protruded shape including a fixing-portion protrusion 76 as shown in FIG. 16. The ground terminal (not shown in FIG. 16) can be fixed to the housing 70 by pressing or crimping the fixing-portion protrusion 76 of the terminal-side fixing portion 74 into or to the housing-side fixing portion 72 formed into the grooved shape as shown in FIG. 16. The housing-side fixing portion 72 may be a hole passing through the housing 70 as well as the grooved shape.

Though the specific examples according to the present invention are described, they are merely examples, and are not intended to limit the scope of claims. The technology described in the scope of claims includes the above specific examples modified or changed in various ways.

For example, the housing is not limited to a metal housing, and may be any conductive housing. For example, the housing may be formed with a conductive resin containing carbon.

Moreover, at least a part of the contact portions between the housing-side fixing portion and the terminal-side fixing portion is exposed according to the embodiments and the variation thereof. For example, the pressing portion formed on the second mold may not have the tubular shape, but may have a shape protruding only at the positions corresponding to prongs for crimping. The fixing space 62 separated from the cavity 60 shown in FIG. 8B may communicate with the cavity 60. Entire portions where the ground terminal and the housing are in contact with each other may be exposed in the cavity. With this configuration, it is possible to provide a connector case where the entire portions where the ground terminal and the housing are in contact with each other are covered with the resin of the connector. In this case, it may not be possible to fill the pressing portion with the resin. However, the pressing portion presses the prongs for crimping or the terminal-side fixing portion from a surface side. Consequently, though parts of the surface of the prongs for crimping or the terminal-side fixing portion are exposed to the outside, the contact portions between the prongs for crimping or the terminal-side fixing portion and the housing can be entirely covered with the resin. Covering the entire contact portions between the ground terminal and the housing can increase the durability of the fixing and the electric connection.

Moreover, when the connector case according to the embodiments is applied to an automotive device, in place of providing an external connector with a member electrically connected to the ground terminal, it is preferable to fix the housing to a vehicle body by means of a conductive member, thereby to connect the housing and the vehicle body with each other electrically, and to cause the electric potential of the ground terminal to be equal to the electric potential of the vehicle body, namely the ground electric potential, through the housing. With this configuration, the connection terminal inside the connector of the housing can be surrounded by the ground terminal at the ground electric potential. As a result, it is possible to electrically shield between the inside and the outside of the connector, thereby preventing external noises from influencing an electrical signal passing the connection terminal, and conversely preventing the electrical signal or the electric power passing the connection terminal from emitting noises to the outside.

Moreover, the terminal referred to as ground terminal and the housing may not necessarily be at the ground electric potential when the connector case is used. The electric potential thereof may be a proper electric potential according to a manner of application.

The technical elements described herein and with reference to the accompanying drawings exhibit technical usefulness either alone or in combination, and are not limited to those described as filed. Moreover, the technologies exemplified herein and in the accompanying drawings can attain multiple objects at the same time, and attaining one of those objects has by itself technological usefulness.

The invention claimed is:

1. A case with a connector comprising:

a conductive housing;

a conductive ground member that is electrically in contact with the housing;

a conductive connection terminal that is not electrically in contact with the housing; and a resin connector having the conductive connection terminal that is formed integrally with the conductive housing, the conductive ground member, and the connection terminal, and insulates between the connection terminal and the housing, and between the connection terminal and the conductive ground member, wherein a housing-side fixing portion that fixes the conductive ground member is formed on the housing and extends upwardly from a side of the conductive housing;

a terminal-side fixing portion provided on the conductive ground member and extending outwardly from the conductive ground member, the terminal side fixing portion having a hole that is crimped to or pressed over the housing-side fixing portion so as to secure the conductive ground member;

a space formed between the housing and the connection terminal and between the connection terminal and the conductive ground member is filled with the resin connector; and at least a part of the conductive ground member is covered with the resin connector, wherein the conductive ground member has a shield portion that extends as a tube along a periphery of the resin connector.

2. The case with a connector as in claim 1, wherein at least a part of a contact portion between the housing-side fixing portion and the terminal-side fixing portion is not covered with the connector.

* * * * *